United States Patent [19]

Kaplan

[11] 4,041,670

[45] Aug. 16, 1977

[54] BUILDING BLOCKS

[76] Inventor: Richard D. Kaplan, 480 Park Ave., New York, N.Y. 10022

[21] Appl. No.: 710,204

[22] Filed: July 30, 1976

Related U.S. Application Data

[63] Continuation of Ser. No. 461,793, April 17, 1974, abandoned, which is a continuation of Ser. No. 214,791, Jan. 3, 1972, abandoned.

[51] Int. Cl.[2] ..... E04C 1/10; E04C 1/30

[52] U.S. Cl. ..... 52/591; 46/25; 52/594

[58] Field of Search ..... 52/286, 272, 591, 593, 52/594, 415, 503-505; 46/25; 264/71; 106/97

[56] References Cited

U.S. PATENT DOCUMENTS

| | | | |
|---|---|---|---|
| 811,534 | 2/1906 | Akers et al. | 52/286 |
| 1,465,115 | 8/1923 | Cordery | 106/97 |
| 2,126,012 | 8/1938 | Hedinger | 52/286 |
| 2,291,712 | 8/1942 | Hatton | 52/272 |
| 2,720,105 | 10/1955 | Billups | 52/594 |
| 3,025,641 | 3/1962 | Ahtiainen | 52/415 |
| 3,277,551 | 10/1966 | Sekiguchi | 264/71 |

FOREIGN PATENT DOCUMENTS

| | | | |
|---|---|---|---|
| 11,180 | 1/1880 | Austria | 46/25 |
| 1,273,609 | 9/1961 | France | 46/25 |
| 157,638 | 1/1921 | United Kingdom | 52/593 |
| 349,130 | 5/1931 | United Kingdom | 52/593 |

*Primary Examiner*—James L. Ridgill, Jr.
*Attorney, Agent, or Firm*—Morgan, Finnegan, Pine, Foley & Lee

[57] ABSTRACT

A building method and blocks in which the blocks have integrally formed joining elements along two axes, including a yin yang element to allow selective reversibility of the blocks to form a self-joint with another yin yang element on another block. The yin yang element is universal, and the shapes, volumes, and areas of a male yang and a female yin member are substantially equal on each side of a bilateral plane through the yin yang self-jointing element. Molded masonry blocks formed from cement, water, aggregate, and chemical admixture are assembled without mortar to provide a building system characterized by numerous advantages. Integral complementary elements on said blocks provide a continuous weatherstop in the assemblage along an axis different from the axis of a side having a yin yang element.

12 Claims, 15 Drawing Figures

BUILDING BLOCKS

This is a continuation, of application Ser. No. 461,793 filed Apr. 17, 1974, now abandoned which in turn is a continuation of application Ser. No. 214,791, filed Jan. 3, 1972, now abandoned.

This invention relates to a method for building structures, and particularly relates to a method of construction consisting of assembling a plurality of improved pressure molded, chemically bonded artificial stone interlocking masonry building blocks, each of which is precise and uniform with respect to its particular shape, dimension and physical characteristics. The invention even more particularly relates to building structures from such novel building blocks by physically and mechanically interlocking one pressure molded stone building block with another without mortar so that the assemblage of said novel building blocks forms an efficient and economical interwoven structural membrane network which conforms closely to a predetermined and predictable rationally engineered system of construction.

BACKGROUND OF THE INVENTION:

Traditionally and historically, load-bearing stone masonry has been the most desirable and widely used system of construction. Traditional masonry construction systems are becoming economically less competitive (and conversely are contributing to the spiraling costs of construction) as a result of increasing on-site labor costs and a decreasing amount of quality material and skilled labor supply.

Conventional concrete masonry product manufacture cakes sand, gravel, portland cement and water and molds them together (usually with vibration) to attain homogeniety and enough compaction to obtain sufficient "green" strength in the products to be transferred onto pallets to steam-curing kilns or autoclaves to obtain their ultimate strength and physical characteristics. As with brick kilns, this mandatory curing process adds an additional and costly manufacturing step both in terms of capital investment and operating expenses. Because of the way in which they are made, and because of the nature of the aggregates used, concrete masonry products are generally "crude" in finish and texture and do not have the same exacting quality requirements, durability, or imperviousness as brick. And as with bricks, concrete masonry products must be mortared together using a thick adhesive bed to compensate for their inherent "roughness".

A construction assembly of such fired clay products thus requires the use of thick mortar joints which not only adhere the bricks together but also correct for the imprecisions and dimensional discrepancies inherent to the bricks. This heat-caused distortion also limits the practical and economical production and utilization of snug fitting interlocking fired clay products. Also, in conventional masonry construction, motar is used as the necessary sealant to obtain weathertightness between the brick structural members.

The use of thick mortar joints to assemble conventional masonry is economically burdensome, because of the specialized labor and quality of workmanship needed. The use of thick mortar joints has other objections, especially is regard to long term maintenance in that it reduces strength and durability and creates inherent problems of weatherproofing.

Traditional masonry bearing-wall construction systems are fundamentally two-material, three-phase building systems consisting of masonry units and the means (motar and skilled labor; necessary to connect them together. In brick masonry, there is brick and mortar (two different materials), and brick-motar-skill (three phases). The mortar ( or jointing system) not only adheres the brick together, but seals the assemblage against weather. But mortar as a joint and sealant is not only weak and brittle, it is also very difficult to apply. The strength and weathertightness of traditional masonry as a construction system is highly dependent on the way in which the joint is made (i.e., workmanship), as well as the inherent structural and other physical characteristics of the bond at the joint.

In conventional construction systems, it is the network of joints (i.e., means of connection) that creates the inherent costly, redundant and sequential erection processes. Although the two-material, three-phase system of bricks and motar (module-cement skill) is widely used and extremely flexible, it has inherent weaknesses and redundancies which render it less and less economical as a building system.

Although bricks are strong and can individually resist as much as 10,000 psi lead in compression, many building codes limit the allowable amount of tensile bond stress to 10 psi in the connecting interface between brick and mortar in masonry. Traditional masonry is often reinforced with tensile-resistive steel, which adds yet another costly material and redundant step in the construction process. There is thus a reduction of up to 80% in the allowable stress resistant capacity of traditional masonry because of the nature of the mortar and the bond between brick and motar.

In addition the nature of the way in which mortar is applied (workmanship) also greatly affects the strength, durability and weathertightness of traditional masonry, and thus building codes further reduce the allowable bearing capacity of masonry by as much as an additional 40% if built with unsupervised labor.

Thus it can be seen that, in traditional construction assemblies, it is the jointing system which requires the skilled labor. It is the nature of the jointing system that determines the nature of the labor involved: welders, riveters, masons, carpenters, etc. Their labor is defined by the type of joints they make. This is so because prior art construction systems conceptually have the joint as something different from, and additional to, the load-bearing structural member.

The great advantages resulting from the precise shape, dimension, and structural uniformity of such masonry blocks does not seem to have been recognized in the art. Likewise, the art has not suggested how such pressure molded masonry units could be economically formed and used to great advantage to assemble structures in a more improved way, particularly a structurally synergistic system of interwoven artificial stone, in which the physical characteristics of the building block and of the assemblage of building blocks are rationally predetermined and predictable.

It is accordingly one important object of the present invention to provide an improved synergistic building system wherein improved structure can be obtained in an improved and synergistic way by assembling precisely shaped and dimensioned integrally interlocking pressure molded masonry building blocks without mortar, thus eliminating the need for a separate and additional jointing system and the time and skill necessary to effect it, i.e., to obtain an improved building system with less time, material, and skilled labor (more-with-less, or true synergy).

Accordingly the present invention provides a building system in which precisely shaped and dimensioned pressure molded masonry building blocks are provided with smooth and parallel surfaces and integral interlocking elements so that a plurality of such precision-made building blocks may be assembled in direct and continuous face-to-face contact between adjacent members without disruption by an intervening thick mortar joint, thus permitting stresses to be transferred directly from one member to the next without the need for an intervening joint or separate and additional "connector".

Another important object of the present invention is to provide improved structure through the use of a one-material, one-phase building system wherein the structural component and the means of connection are one. In other words, it is an important object of the present invention to provide a system of masonry construction with inherent and integral jointing capacity, wherein each masonry building block in itself contains the means of improved connection with another masonry building block, i.e., the novel yin yang jointing system is inherent in the novel building block, thus reducing the number of redundant processes necessary to build structures with a plurality of said building blocks. The assemblage of the whole structure is inherent in and determined by the nature of the individual building block and the geometry of the locking elements. In structures built according to the system of the present invention, for the cost and effort of weaving structural membranes out of a plurality of the improved pressure molded interlocking masonry building blocks of the present invention, the practitioner simultaneously obtains speedier and more efficient finished enclosure of space; automatic weathertight and maintenance-free, fireproof construction; thermal and acoustic insulation; inherent structural integrity, strength and stability; durability; permanence, as well as easy assembly and disassembly.

The present invention is advantageous an improved building system wherein improved pressure molded masonry building blocks with integral physically interlocking elements are formed by using a variety of aggregates, such aggregates consisting of any mineral raw material, including aggregates derived as by-products, or as recycled waste materials, from industrial, manufacturing, municipal or other operations.

The foregoing objects are attained together with still other objects which will occur to practitioners from time to time, from considering the building method and building blocks disclosed herein.

DESCRIPTION OF THE DRAWINGS:

The use of the same numerals in the different views of the drawings shall be a reference to the same structures, parts, or elements, as the case may be.

Figure 1:
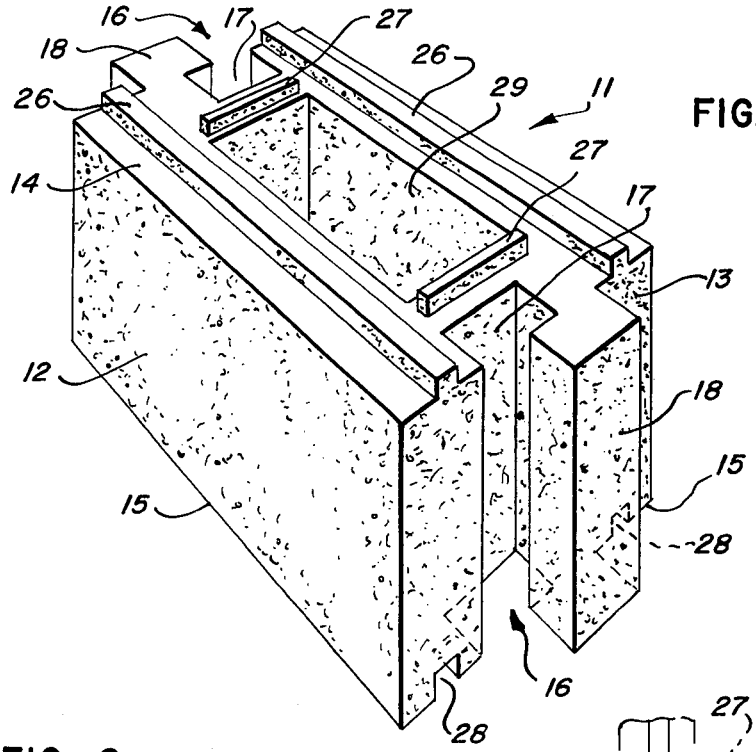
FIG. 1 is a perspective view of an improved pressure molded masonry building block having both horizontal and vertical integral interlocking elements.

There are five basic concepts inherent to the present invention. The first two concepts are concerned with the manufacturing technology of the masonry building blocks: (1) pressure molded, and (2) chemically bonded. The three other concepts are concerned with the system of assembly of a plurality of the building blocks: (3) utilizing precise and uniformly shaped building blocks formed with integral two-way horizontal and vertical continuous jointing and weatherstopping devices, (4) assembling them together in staggered stacked bond interlocking relationship, (5) without the obligatory use of mortar, adhesive, or additional connecting device.

The simultaneous utilization of these five basic concepts is the most important object of the present invention and gives this system for building structures its novelty, its economy, its practicality, and its ability to be rationally analyzed and designed.

The pressure molded masonry building blocks of the present invention are formed with integral means to physically and mechanically interlock with similar units, so that a plurality of such pressure molded building blocks may be assembled into continuous structure without mortar and the concomitant disadvantages associated with the need for, and the use of, such mortar. The individual pressure molded masonry building blocks are formed precisely, uniformly, and rationally. The term rational is intended to mean that the physical characteristics of the individual pressure molded interlocking masonry building blocks are predetermined in accordance with particular and systematic structural, engineering, and manufacturing concepts. Predetermining the rational criteria for the improved individual building blocks allows rational criteria for the improved assembled plurality of building blocks also to be predetermined. This is especially so because the pressure molded building blocks have smooth and parallel interfaces and are assembled together without mortar (or intervening and separate connecting device), thus enabling the stress on one building block to be transmitted directly to the next without loss. By way of illustration, in a conventional masonry bearing wall axial load is transmitted from one brick to the next through a mortar joint, thus developing triaxial stress between mortar and brick which increases the total stress-load the wall must resist. Because of the difficulty of predetermining the structural action of the total stress-load in conventional masonry, it is generally "overdesigned" and thus inefficient: It must use more materials to resist a given stress.

DESCRIPTION OF THE INVENTION

The individual pressure molded interlocking masonry building blocks are made by combining the selected aggregate with selected amounts of chemical admixtures, a common one being a solution of calcium chloride, generally used to accelerate the process of hydration of the cement. A batch of the mixture is deposited in a mold, and is compacted together in a press. By depositing a selected weight of a batch in a mold, the shape, dimensions, and physical characteristics of the resulting pressure molded masonry building block can be accurately and precisely controlled. The deposited batch is then molded at selected pressure levels over selected time periods, which are standardized for any given pressure molded masonry building block. The resulting uniform, consistent, and standard masonry building block of precise shape, dimension, and physical characteristics is removed from the mold, and whatever additional "curing" occurs is completed usually at room temperatures or slightly elevated temperatures. By depositing an equivalent batch of an equivalent mixture in the same or similar mold, and using the equivalent pressures and time, replicate pressure molded, chemically bonded, interlocking masonry building blocks are obtained which are precise, standardized, and uniform in shape, dimension, and physical characteristics.

The aggregate used in the manufacture of the pressure molded interlocking masonry building blocks of the present invention may be any solid mineral or combination of such minerals, which generally remain in their inert state and generally do not combine chemically with the cement, water, or admixtures. The aggregates are used generally in a pulverized state with a gradation of particle size. The particle size distribution profile of the aggregate is of significant importance in the present invention, as the degree of theoretical compaction of the particles in the building block as achieved under pressure determines the resulting physical characteristics.

Indeed, the art has recognized, for example, that various types and sizes of aggregate can be used to contribute different characteristics to concrete masonry products in general. This is likewise true for pressure molded interlocking masonry building blocks. It is a particular advantage, from both the economic and ecological point of view, that aggregates derived as byproducts, or as recycled "waste" materials from various manufacturing, industrial, commercial, and municipal operations, such as fly ash, slag and mine tailings, crushed glass, incinerated garbage residue, etc., may be usefully incorporated into the precision made pressure molded interlocking masonry building blocks of the present invention.

By way of illustration only, the art has recognized useful aggregates resulting from a residual mass following destructive distillation of raw garbage, as disclosed in U.S. Pat. No. 3,383,228; the use of sawmill wastes and stone chips as disclosed in U.S. Pat. No. 2,877,135; the use of clay as disclosed in U.S. Pat. No. 2,918,385; the use of furnace slag as shown in U.S. Pat. No. 2,947,643; the use of sewage sludge and fly ash as shown in U.S. Pat. No. 3,030,222; the use of rock in a gradient of various sizes from $\frac{1}{4}$ inch to $-100$ mesh, as shown in U.S. Pat. No. 3,366,720; and other types and size distributions of aggregates as disclosed generally in the concrete art, including waste mineral aggregates not previously recognized as having utility.

Other aggregates include cement dust, marble, gypsum, asbestos, sand, crushed glass, dolomite, calcite, vermiculite, granite dust and chips, limestone, kaolin, silicous rocks, and still others. The inert mineral aggregate material characteristics are selected by considering various parameters, including type, unit weight, specific gravity, maximum size and particle size distribution profile, hardness, elasticity, plasticity, crushing strength, absorption of water, and still others. An admixture is defined by the ASTM (C-125) as: "A material other than water, aggregates, and Portland cement (including air-entraining Portland cement and Portland-blast furnace slag cement) that is used as an ingredient of concrete and is added to the batch immediately before or during its mixing." An admixture is used to modify the properties of the improved pressure mold-interlocking building blocks in such ways as to make them more suitable for the work at hand.

More detailed descriptions of the mixture will not be made since pressure molded masonry products as such are known in the art, and as such, they do not in themselves comprise a novel portion of the present invention. However, the great advantages resulting from the ability to transform virtually any mineral aggregate material into precise and accurate pressure molded interlocking masonry building blocks do not seem to have been recognized in the art. This then makes available to the manufacturing process a virtually unlimited source of inexpensive and universally available raw material.

Thus, it can be appreciated that the system of building of the present invention is a novel way to build not just buildings but roads, dams, bridges, canals, bulkheads, flood control systems, water sheds, and still others, and it can be done quickly (here's where dollars are saved) and easily by hand (which helps solve unemployment, especially of unskilled labor), as the cost of cleaning our environment and recovering "lost" resources.

DESCRIPTION OF THE PREFERRED EMBODIMENTS

Figure 2:
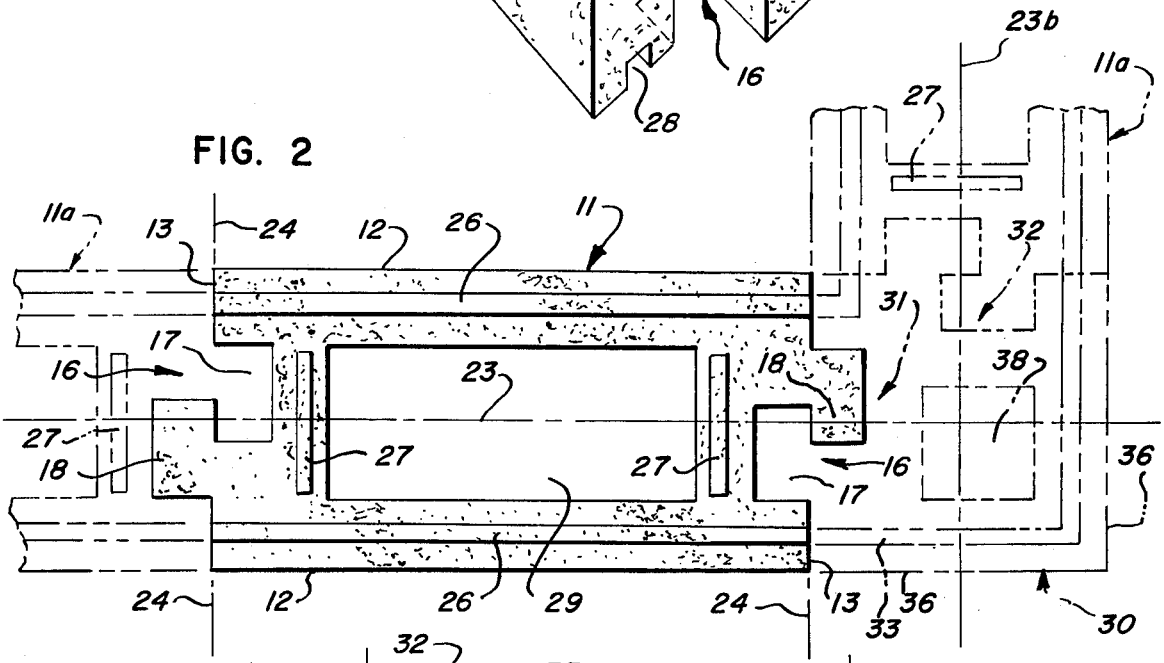
FIG. 2 is a top plan view of the typical building block shown in FIG. 1 in typical horizontal interlocking relationships with adjacent blocks shown in phantom.

Referring now to the drawings which illustrate pressure molded masonry building blocks and the preferred ways in which they may be assembled together in interlocking relationship to form structures:

The building block of FIG. 1 is a perspective view which includes a unit having a plurality of sides including top 14 and bottom 15 and an opposite pair of end sides together with integral complementary elements 26 and 28 for effecting continuous weatherstops along top and bottom sides 14 and 15 when assembled with similar blocks, and an integrally formed unitary self-jointing element 16 on at least one side of the unit, the self-jointing element being complementary with similar elements on other blocks and comprising on the right hand end, element 18 inboard from side wall 11 and extending beyond the block and forming a male locking projection and contiguous therewith, element 17 inboard from the opposite side wall 12 recessed into the block and complementary with element 18 and forming a female locking recess complementary with said formed male locking projection. It is seen that the shape, area and volume of the formed male locking projection and the formed female locking recess are substantially equal and that the self-jointing element is adapted to join with a complementary substantially similar self-jointing element on a side of another building block. In the block of FIG. 1, as shown in FIG. 2, the formed male locking projection 18 is capable of snug interfitted relationship with the complementary formed female locking recess 17 of adjacent similar blocks 11a and 30. It is also seen that this interfitting relationship enables block 11 to be selectively reversible around an axis, thus enabling each self-jointing element to universally join with a complementary self-jointing element on another block without disturbing the continuous weatherstops along the top side 14 and bottom side 15 when assembled with other similar blocks.

FIG. 1 further discloses a building block in which top side 14 includes continuous raised strip 26 and bottom side 15 includes continuous recessed slot 28, and furthermore, it illustrates a block in which the self-jointing element 16 has projected strip 18 and recessed slot 17, in this case the self-jointing element being continuous between top side 14 and bottom side 15, thus effecting continuous weatherstops.

Also illustrated in FIG. 1 is a building block in which projected strip 18 and recessed slot 17 are substantially rectangular in cross-section. Further illustrated in FIG. 1 is a building block in which projected strip 18 is laterally offset with respect to recessed slot 17 so that the self-jointing element comprises an L-shaped hook and an L-shaped catch.

The block illustrated in FIG. 1 is a stretcher block having self-jointing elements on two opposite sides.

Figure 7:
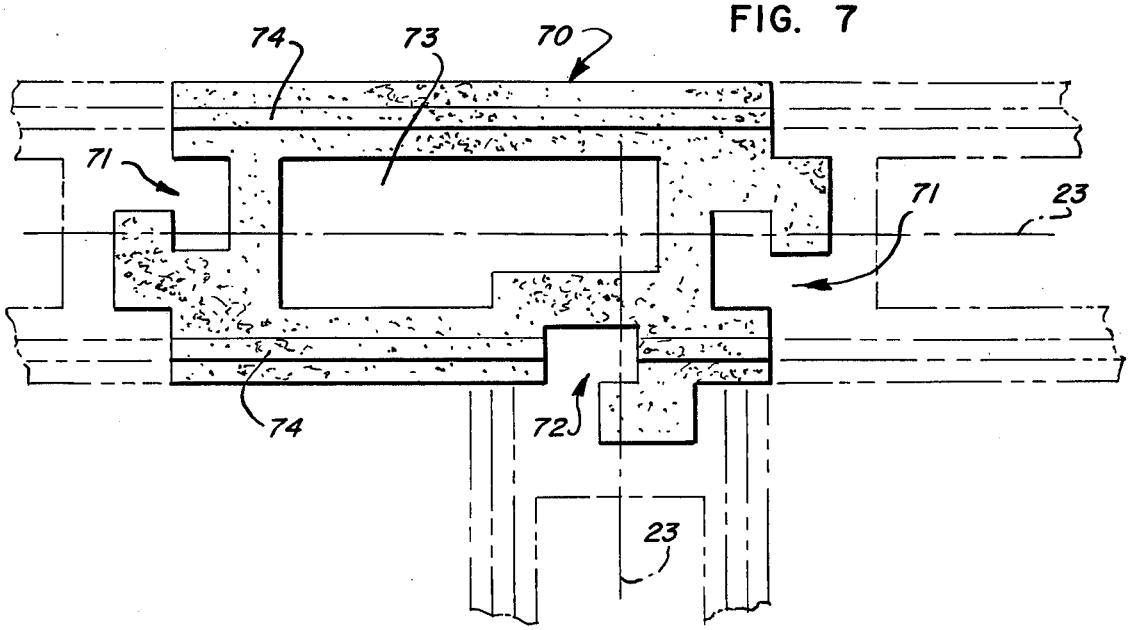
FIG. 7 is a top plan view of another building block used as a tee component for mid-block interlocking with other building blocks in a structure assembly.

The block illustrated in FIG. 7 is like the stretcher block except that it also includes a third self-jointing element normal to the two opposite sides containing self-jointing elements.

Figure 3:
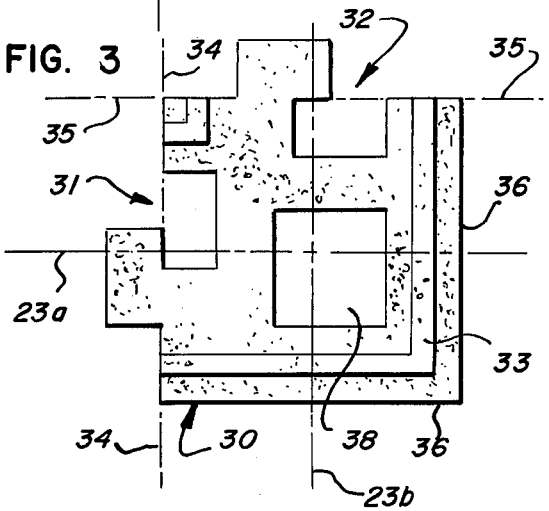
FIG. 3 is a top plan view of another building block used as a corner component in a structure assembly and shown in typical interlocking relationships with adjacent blocks shown in phantom.
Figure 5:
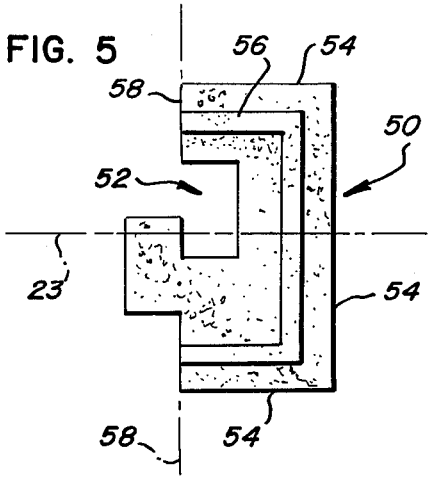
FIG. 5 is a top plan view of another building block used as an end or jamb component in a structure assembly.

In FIG. 3 is illustrated a corner block having two self-jointing elements on two adjoining sides. In FIG. 5 is illustrated a jamb or end block 50 having a self-jointing element on one side.

Figure 9:
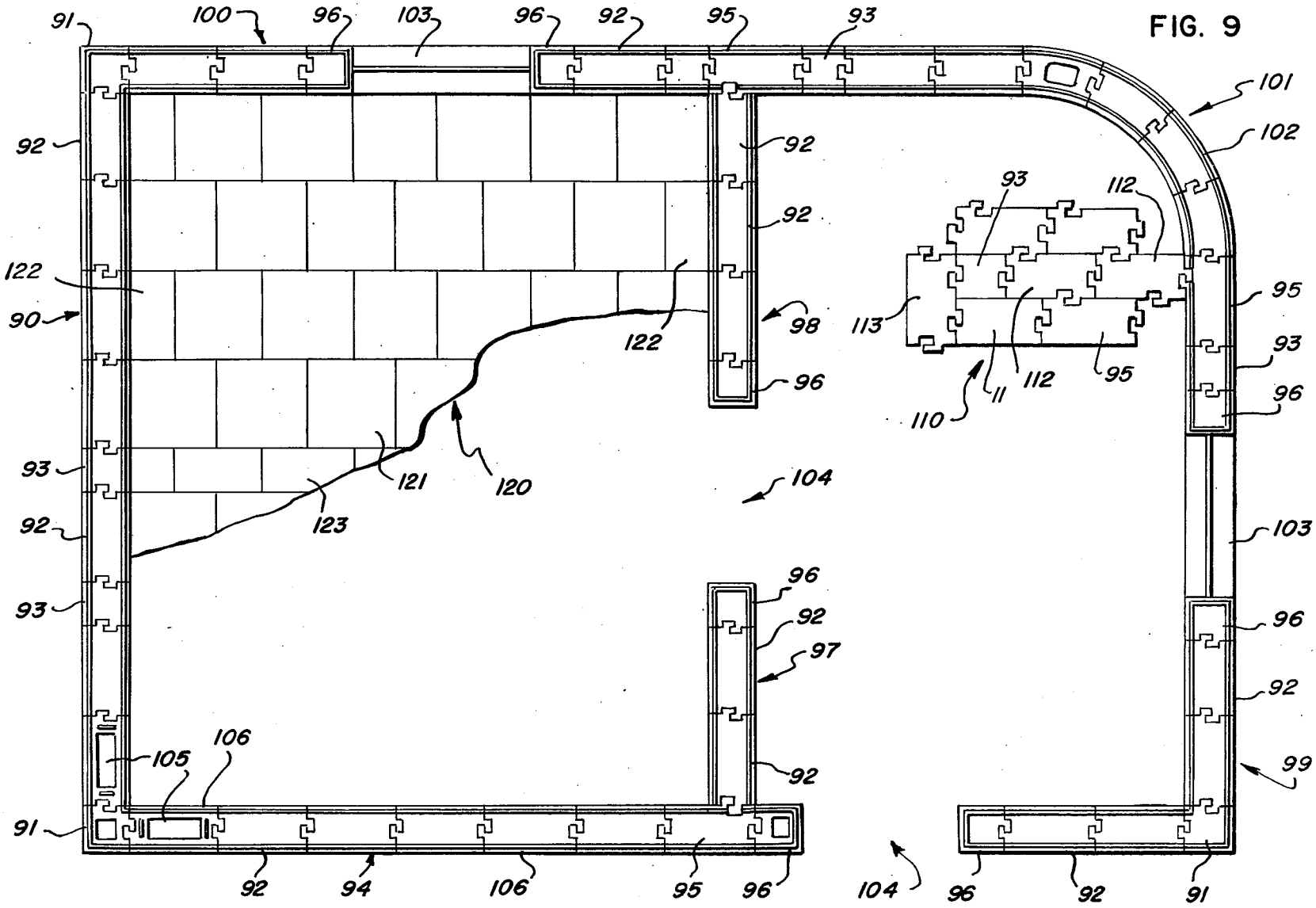
FIG. 9 is a top plan view of various prototypical wall and floor assemblies utilizing as components the building blocks shown in the foregoing views of the drawings.

In FIG. 9, block 112 illustrates a center block having self-jointing elements on four adjoining sides.

FIG. 1 also illustrates a block according to this invention wherein top side 14 includes spaced continuous raised strips 26 and spaced transverse raised strips 27 and the bottom side includes complementary continuous recessed slots 28 and spaced transverse recessed slots (not shown).

FIG. 1 and FIG. 2 illustrate respectively a perspective view of a typical improved pressure molded masonry building block used in the building system, and a plan view of said typical block shown in typical horizontal relationship with adjacent blocks, shown in phantom. The typical building block 11 in FIG. 1 and FIG. 2 also referred to as a "stretcher," is shown in the generally preferred form of a rectinlinear block having parallel sides or "faces" 12, ends 13, and a top 14, and a bottom 15.

At the ends of the typical building block 11 are collectively shown the novel and improved integrally formed self-jointing yin yang locking element 16. The locking element separately includes a yin or female element 17 and a yang or male member 18. It is understood that the term "yin yang" derives its meaning from ancient Chinese cosmology which states that in nature, the yin (the feminine passive principle—as of darkness, cold or wetness) combines with yang (the masculine active principle—as of light, heat or dryness) to produce all that comes to be. The yin yang symbol is the world's oldest recorded graphic symbol

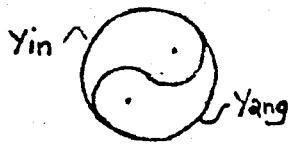

representing male and female members joined together in a specific complementary interlocking relationship, and it is used in the present invention to describe the improved type of joint, illustrating the concept of an integrally formed self-jointing element in which both male and female members are simultaneously present in each jointing element, such that equivalent and opposing forces and interfaces may be interlocked together to create harmony, unity, and integrity. The yin yang is the symbol of opposing forces which together make harmony.

The prior are of interlocking masonry systems of construction utilizes jointing elements which fall into two general categories:

1. Systems in which blocks have integral jointing elements which are either male or female, the two opposing "sexual" elements being disposed generally at opposite ends or sides, said elements being interlocked by uniting the complementary shapes: the male of one joint element interlocks with the complementary female of the other jointing elements, as by tongue and groove or ball and socket, which are well known in the art.

2. Systems in which blocks have jointing elements which are both male or female, and wherein an additional and separate non-integral jointing device is necessary in order to interlock and unite the blocks, such as the well known use of keys to interlock aligned grooves in adjoining blocks.

It can be seen that prior art systems of masonry construction which employ integrally formed "tongue and groove" jointing devices on the vertical planes cannot be rotated horizontally in relation to one another and still retain their matability. They can, of course, be flip-flopped (or rotated along the vertical axis) to reverse the two "faces," but in so doing a continuous integral weatherstop between the horizontal surfaces cannot be effected.

Referring now to FIG. 1, the novel yin yang locking element 16 may be described as being "bisexual"; in other words, the yin yang locking element has in itself both male 18 and female 17 members. This may be viewed as a universal locking element, as opposed to tongue and groove locking which has in itself either male or female members. The yin and yang members of one improved locking element interlock with similar yin and yang members of another locking element. There are thus two male members and two female members in interlocked relationship at each connection.

The yin yang element is thus capable of self-jointing with similar yin yang elements in a universal manner. This further advantage of the present invention provides the novel "horizontal" reversibility of typical pressure molded integral interlocking masonry building blocks such as 11 with two yin yang locking elements which are integrally formed on other blocks.

The complementary yin yang locking elements are integrally formed with the building block, and the yin and yang members 17 and 18 are doubled back, or formed as around-and-in members, relative to each other and to a bilateral dissecting plane 23. The yin and yang locking members are inboard from the opposite faces of the block at generally equal distances to provide the required around-and-in, doubled-back-upon-itself yin yang configuration. The relationship provides a great number of adjoining or abutting mutual surfaces to enhance the interlock.

The typical yin yang joints are shown in FIG. 2. The members 17, 18 are shown as rectangular, but it will be appreciated that such yin yang locking members may have other polygonal or curvilinear configurations. It is desirable in the preferred configuration that the yin yang joints have common interfaces which double back on themselves so that such a yin yang element on one block forms an around-and-in interlocking relationship with a like yin yang element on an adjacent block. In other words, in the preferred yin yang joint, each around-and-in member, or member doubled-back-upon-itself, symetrically overlaps a bilateral plane 23, which is shown in FIG. 2 coincidental with the longitudinal axis of the typical block 11, to effect a positive two-way interlock.

Figure 2A:
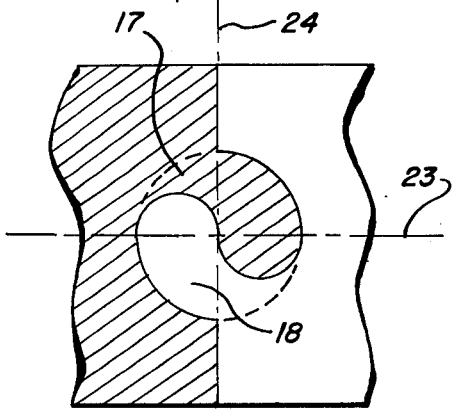
FIG. 2A is a representation of the ancient yin yang symbol with references of relation to the present invention.

It is also required that in any given system yin yang members be complementary in the sense that the shape, area, and volume of the yin and yang members be substantially equal on each side of end plane 24. It is also provided that a bi-lateral plane 23 dissects the yin yang element at each end of typical block 11 so that the shape, area, and volume of each locking member on one side of the bilateral plane 23 is substantially equal to the shape, area and volume of the other locking member at the same end but on the other side of said bilateral plane. The yin locking member 17 is understandably slightly larger than the yang locking member 18 to accommodate an interlocking mating relationship; that is, to form the yin yang joint. The shape, area, and volume of a yin yang element on one end of typical block 11 is also substantially equal to the shape, area and volume of a similar yin yang element on the other end of the block. Reference to FIG. 2A will show the analogy between the classical yin yang symbol and the yin yang element relative to one end of a typical block 11. It is seen that the inboard female yin member completely surrounds or is formed around the inboard male yang, member, such members defined by end plane 24. This results in a most effective and secure two-way interlock or yin yang joint, including lateral face portions outside the yin and yang members which abut in face-to-face relationship at the adjoining ends, as shown in phantom in the view of FIG. 2.

The yin yang elements on typical block 11 are shown positioned 180° part, and this positioning permits forming a physical interlock with similar yin yang locking elements on one of opposite ends or sides of like adjacent blocks. A practitioner will appreciate the advantages of a building system which employs a two-faced building block which is capable of reversibility without impairing its integral weathertightness.

When interlocked together such yin yang elements may also be considered as forming horizontal interlocks in the sense that the yin yang interlock prevents displacement of adjacent blocks along a horizontal axis common to both blocks while at the same time forming a continuous integral positive weatherstop between the mating vertical surfaces.

It is another important object of the present invention that such block be provided with integral means for forming a continuous vertical interlock which at the same time may operate as a positive weatherstop between the mating horizontal surfaces. Such means include an integrally formed pair of spaced elongated ribs or projections 26 on the top of typical block 11 which form an interlock with complementary elongated grooves or recesses 28 at the bottom of an adjacent similar block. The complementary elongated projections and recesses are preferrably continuous in the sense that they extend to the ends of the block. This provides continuous positive weather-stops against easy penetration by liquid or gas between the horizontal surfaces, as well as an interlocking relationship. The paired projections 26 are shown equally spaced from the bilateral plane 23, and a similar relationship is shown for the paired, complementary recesses 28 on the bottom of the block.

Figure 8:
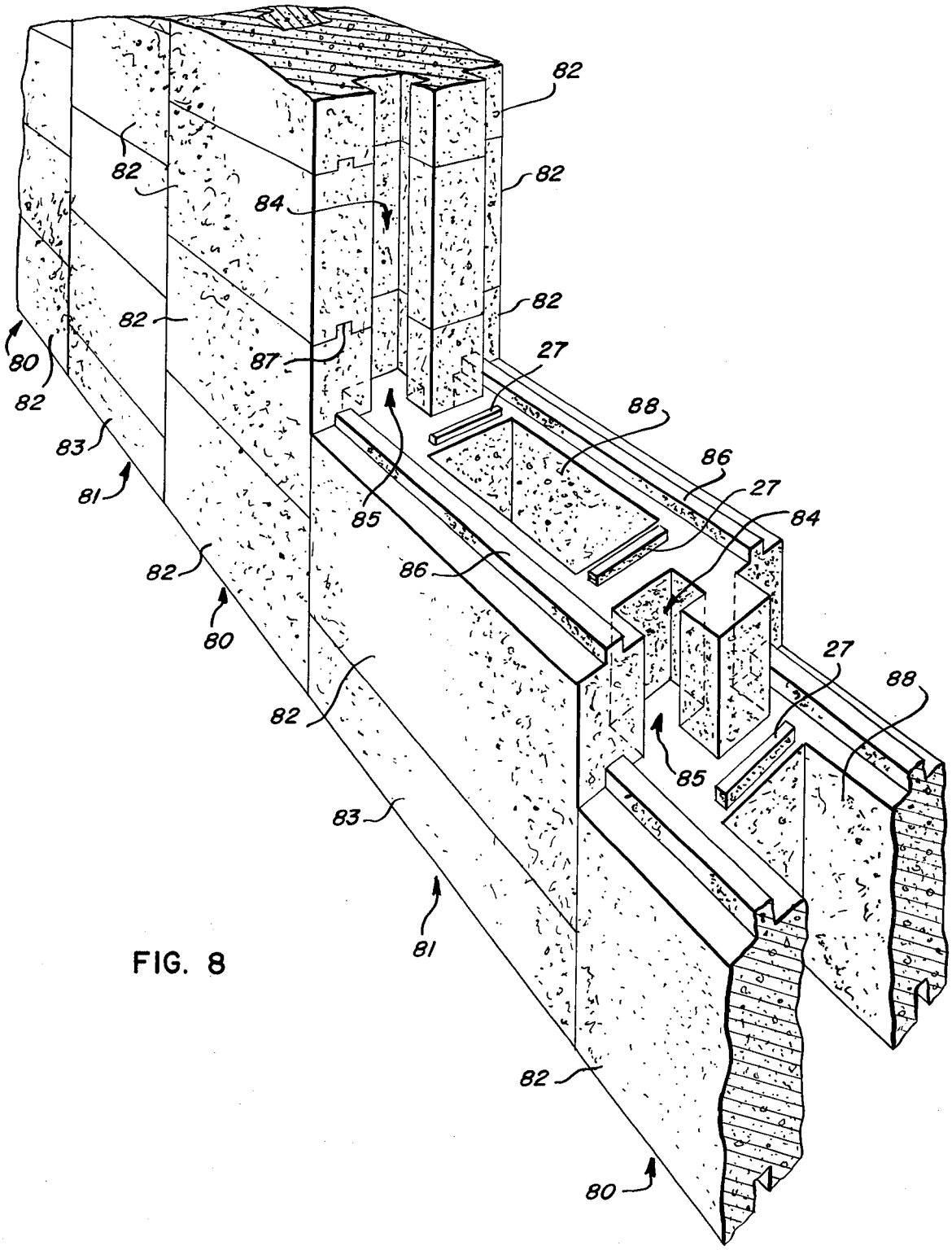
FIG. 8 is a cutaway perspective showing building blocks similar to that shown in FIG. 1, such building blocks being of varying heights to attain a vertically staggered stack bond interlocking relationship in a structure assembly.

It will be understood that when such blocks are stacked upon each other, as shown in FIG. 8, the projections 86 and recesses 87 form continuous vertical interlocks while simultaneously providing continuous integral weatherstops between the mating horizontal surfaces. The preferred embodiment also includes transverse ribs or projections 27 between the elongated projections 26. A pair of complementary spaced transverse grooves or recesses are on the bottom, not shown, between elongated recesses 28.

It will be seen that improved construction is obtained by providing blocks with interlocking elements along two axes, one normal to the other. The sides parallel to one axis are provided with yin yang locking elements, and the sides parallel to the other axis are provided with the projection and recess locking elements. This may be done in another way as will be seen later in describing another embodiment.

FIG. 3 illustrates a building block suitable as a right angle corner block 30 having yin yang locking element 31 on one end, being on end or plane 34, which is 90° from end or plane 35 on which is located a complementary yin yang element 32 which is in similar relationship to plane 35 and bilateral plane **23*b* as yin yang element 31 is to plane 34 and bilateral plane 23*a*. The elongated projection 33 parallels the shape of the corner block and extends between the ends 34 and 35 containing yin yang elements. The right angle corner block has face sides 36 which form a dihedral at the corner of an assembled structure. The corner block is shown in relationship with adjacent blocks in phantom in the view of FIG. 2, with yin yang element 31 of the corner block in interlocking relationship with complementary yin yang element 16 at one end of typical block 11. In FIG. 2 yin yang element 32 of the corner block is also shown interlocked with a yin yang element on another block 11a, in phantom, so that such other block may be at right angles to typical block 11**.

It will be seen that the raised elongated projection 33 on the corner block indicated in phantom in FIG. 2 abuts the raised projection 26 on block 11 so that a continuous horizontal weatherstop is effected in the assemblage. It will also be seen that both the typical block 11 and the corner block 30 are cored, or have central passageways, such as 29 in typical block 11, and 38 in corner block 30. These cores are provided for reasons of reducing weight and materials, and when assembled in the manner such as shown in FIG. 8, provide a continuous passageway suitable for installation of such features as piping, conduit, reinforcing rods, concrete, insulation, ducts or the like. When used as a floor or like system, the advantages of continuous horizontal passageways will be appreciated by practitioners. Further advantages of the present building system will be appreciated by practitioners who employ the improved staggered stack bond interlocking masonry system which provides clear and continuous vertical and/or horizontal cores or passageways throughout a continuous structural membrane network.

Figure 4:
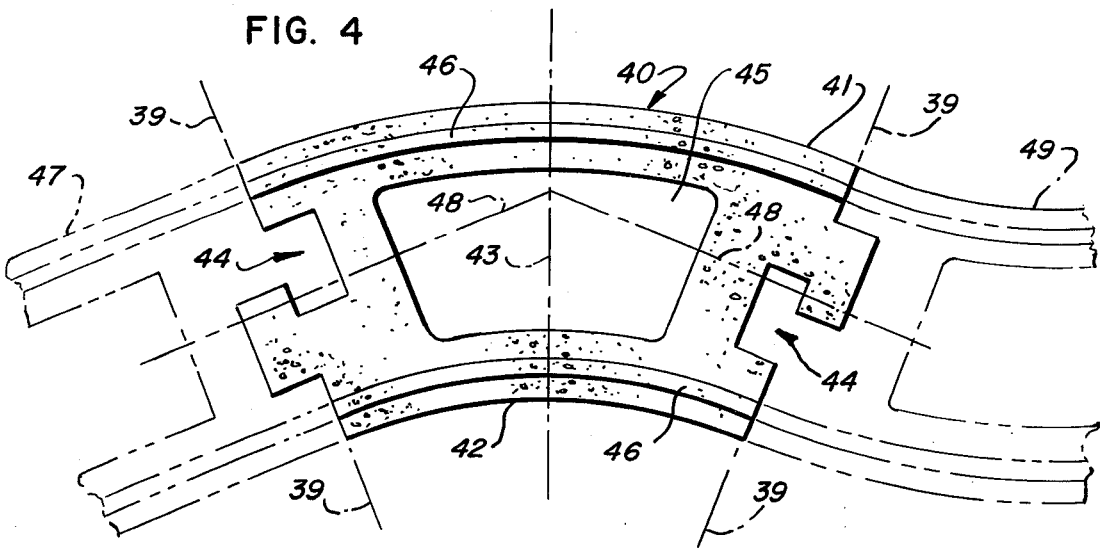
FIG. 4 is a top plan view of another building block used as a component in a curvilinear or non-rectilinear structure assembly and shown in typical interlocking relationships with adjacent blocks shown in phantom.

A building block 40 for forming a curvilinear assemblage in a structure is shown in FIG. 4, such block having a longer outer curvilinear side 41 which is parallel to the shorter inner curvilinear side 42. Each end 39 has complementary yin yang elements 44. On the top of the block 40 are shown raised paired elongated projections 46, and complementary paired elongated recesses would be on the bottom, not shown. The block has a core 45. Additional pressure molded building blocks of various configurations may be interlocked with the yin yang elements 44 such as rectilinear block 47 and curvilinear block 49 being partly indicated in phantom.

The complementary yin yang elements at opposite ends of block 40 have the same relationship to each other as described in association with FIG. 1 and FIG. 2, and have complementary areas, shapes, and volumes in similar relationships to those discussed above. The bilateral planes 48 dissecting each yin yang element coincide on bilaterally symmetrical plane 43 of block 40. It can be appreciated by practitioners that a plurality of blocks of other radii of curvature, or of angular or other shapes, may also easily be employed in this improved building system.

The block shown in FIG. 5 is an end or jamb block 50, which has only one yin yang element 52. Such a jamb block has three face sides 54, and the top has an elongated raised projection 56 which follows the sides 54. The elongated raised projection has a complementary recess on the bottom of jamb block 50, not shown. The projection 56 is continuous in that it extends between spaced portions of the same end or sidewall 58. Because of the inherent reversibility of the bisexual yin yang locking element, only one end or jamb block shape is generally needed in the building system for providing uniform self-framed openings in assembled structures (as opposed to a minimum of two shapes generally necessary in prior art interlocking systems). This further advantage of the present building system will be appreciated by practitioners.

Figure 6:
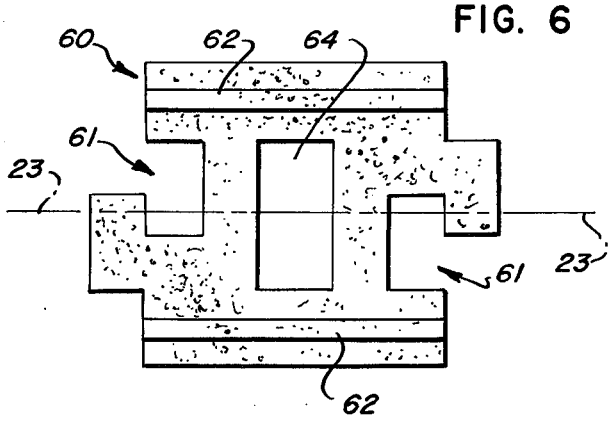
FIG. 6 is a top plan view of another building block which is similar to the building block of FIG. 1, but of different length to serve as a filler component in a structure assembly.

FIG. 6 illustrates a pressure molded building block 60 which is used as a filler block, and which is similar to the typical block 11 shown in the view of FIG. 1, except that it has a different length. The filler block 60 has yin yang elements 61 at opposite ends, and a pair of spaced continuous end-to-end elongated projections 62 shown on the top, with complementary spaced elongated recesses on the bottom, not shown. The filler block may have a longer or, as shown, shorter length between the opposite yin yang elements than the typical block 11 shown in FIG. 1. Such a filler block is also provided with a core 64. Filler blocks of different lengths and shapes are used to fill various sized spaces in a structure assembled from a plurality of building blocks of the present building system.

Block 70 shown in FIG. 7 is a tee component which has yin yang locking elements 71 at opposite ends of the block, and a third yin yang locking element 72 on a side at right angles to the ends. The yin yang element 72 on the side is shown positioned substantially closer to one of the end yin yang elements 71, but it may otherwise be placed. A typical block such as that shown in FIG. 1, or a filler block such as that shown in FIG. 6, or other block may be interlocked with the yin yang element 72 to form a tee-shaped, or mid-block right angle connection, with the tee block 70. Other configurations will be obvious to the practitioner, and it will be appreciated that similar building blocks may have three or more complementary yin yang elements on a multiplicity of sides, and thus many different combinations and permutations of assembled relationships may be effected. Indeed, it can be appreciated that walls, for instance, of one or more layers in thickness may be assembled through use of building blocks with multiple complementary yin yang locking elements on different sides, as will be shown later.

FIG. 8 is a cutaway perspective showing an assembly of typical building blocks in a vertical plane. Typical vertical course 80 is shown started at the bottom with a typical building block 82 (similar to that shown in FIG. 1). Additional typical blocks 82 are stacked on top of the starter block in vertical course 80. Vertical course 81 is shown started at the bottom with building block 83 of reduced height, shown here as one-half the height of typical block 82. It can be seen that, in the preferred embodiment, adjacent courses in an assemblage begin with building blocks of different heights, and generally that alternate courses in an assemblage start with blocks of the same height, so that the building blocks in one course are staggered relative to the blocks in the immediately adjoining course, thus preventing one course from displacement relative to its neighbors.

To assemble building blocks, as shown in FIG. 8, it is preferable to begin with a flat, smooth and level surface or foundation. Different height starter blocks, such as 82 and 83, in alternate courses 80 and 81 are then interlocked together by means of the complementry yin yang elements 84 and 85 on adjacent blocks, one block easily being slid downwards in relation to the next to effect a staggered stack bond mortarless interlocking relationship. Additional blocks are then stacked upon each other in their respective vertical courses by sliding one block downwards past the next. To achieve a staggered stacked assemblage with a level top, terminating blocks of complementarily different heights may be added.

The staggered stack interlocking relationship plus the yin yang locking elements present the displacement of the building blocks relative to one another, and this interweaving concept is yet another important object of the present invention in that it provides the system of construction with its inherent self-reinforcing capabilities and other improved physical characteristics.

Practitioners will also recognize that because of the universality of the bisexual yin yang locking elements, building blocks may be rotated in the horizontal plane (for instance, 180° for the typical block in FIG. 8). This will make available for use either of the two sides or faces 12 of the typical building block as shown in FIG. 1. This horizontal reversibility is attained without loss of the continuous positive weatherstop and interlock between the mating horizontal surfaces. This reversibility, horizontal or otherwise, is yet another important object of the present invention.

Referring still to FIG. 8, it can be seen that in addition to effecting a vertically staggered interlocking relationship between adjacent building blocks and courses of building blocks, the yin yang elements effect an integral, positive, continuous, mortarless, weathertight joint between the mating vertical surfaces. Likewise, it can be seen that the integral, continuous, elongated projections 86 and complementary continuous recesses 87 effect an integral, positive, continuous, mortarless, weathertight joint between the mating horizontal surfaces, as well as an additional interlock about the vertical axis. It can thus be appreciated that another important object of the present invention is a mortarless system of interlocking masonry building blocks which, when assembled together in a manner similar to that indicated in FIG. 8, results in a structural assemblage in which no through joints are created between mutually mating surfaces, thus effecting a continuous, integrally weathertight, interlocking structural masonry membrane.

It can also be seen from FIG. 8 that the resulting assemblage attains positive integral mortarless interlocking weathertight joints simultaneously along both the vertical and horizontal axes, as well as self-reinforcement, especially against flexural stress, by means of the staggered stacking relationship. In addition, it can be seen that the snug-fitting interrelationships between the yin yang elements 84 and 85 and the projection and recesses 86 and 87, combined with the smooth and parallel surfaces obtained as a result of the pressure molding processes, results in a structural assemblage which is inherently self-aligned and self-plumb.

In FIG. 8, continuous cores 88 are shown, and it can be seen that they not only reduce the material and weight of the building block, but provide a continuous, inherently insulating, air passageway that, becuase no mortar is used which in ordinary masonry construction normally spills over into the cores, can easily be utilized for the installation of building sub-systems such as steel or concrete reinforcement, plumbing, piping, wiring, ductwork, insulation, and still others.

It is intended in the foregoing discussion that vertical and horizontal are relative terms and refer specifically to the vertical assemblage shown in FIG. 8. However, it can be appreciated that such a typical assemblage may be obtained in horizontal or inclined planes and/or in curvilinear or angular configurations, as well as, and in addition to, assemblages in the vertical plane.

Figure 10:
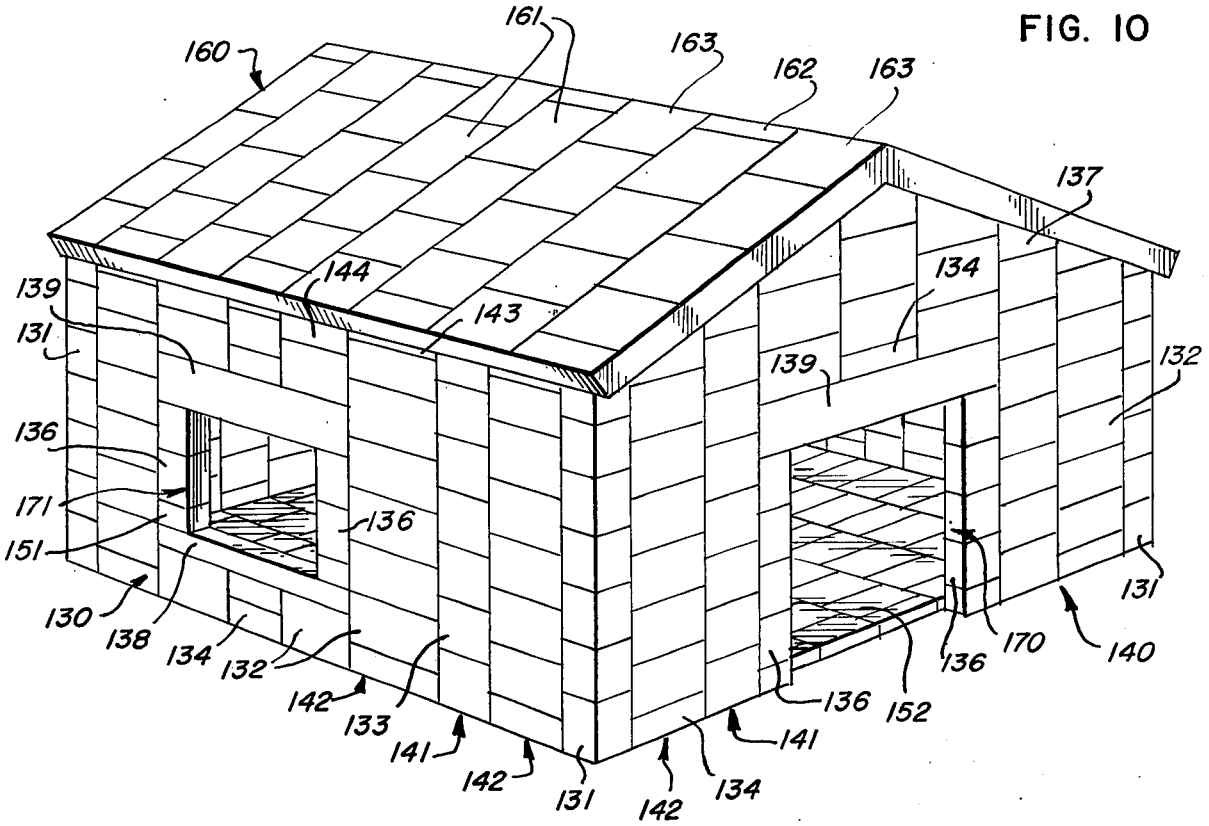
FIG. 10 is a perspective view of a prototypical structure assembly utilizing as components the building blocks shown in the foregoing views of the drawings and still others.

FIGS. 9 and 10 illustrate, in a prototypical way, how the foregoing building components may be assembled together to form various parts of a structure. In the plan view of FIG. 9, wall 90 is assembled from a plurality of corner blocks 91, typical building blocks 92 such as shown in FIG. 1, and filler blocks 93. Wall 94 is assembled from a plurality of typical building blocks 92, a tee block 95, and jamb block 96. Wall 97 shows adjacent courses of interlocked typical blocks 92, one of which is interlocked with tee block 95, while another typical block 92 has a jamb block 96 interlocked therewith. Similar building blocks may be seen in walls 98, 99, and 100. Wall 101 includes curvilinear blocks 102. Window sill elements 103 are shown in interlocked relationship between some of the adjacent walls and jamb blocks 96. Doorway passages 104 are shown between other spaced walls and jamb blocks 96. Continuous cores 105 are shown in some of the courses of building blocks, and continuous horizontal raised projections for interlocking and providing weatherstops are indicated at 106.

Floor and roof structural assemblies may be assembled from a plurality of building blocks, as shown in partial completion in FIG. 9. Similar horizontal or inclined planar structures may also be assembled to extend from upright wall structures. Two alternative assembly configurations are shown at 110 and 120. At 110, generally, a tee building block 95 in wall 101 is shown interlocked to a block 112 having yin yang elements on each of four sides. The assembly is shown with other blocks 112, as well as tee blocks 95, stretcher block 11, and filler block 93. The blocks are interlocked to one another, and block 113 is shown with two yin yang elements on one side for interlocking two adjoining blocks, as shown. Different blocks with multiple yin yang elements may be variously assembled to build floor structures or the like.

Similarly, walls of two, three, or more layers thick may also be assembled from a plurality of building blocks integrally formed with multiple yin yang elements, and 110, generally, may also be viewed as a partial cross section through such a multi-layered wall.

A floor assembly, such as at 120 generally, is shown assembled by sliding blocks together horizontally in the same manner as the wall in FIG. 8 is assembled by sliding blocks together vertically. Typical blocks 121 are illustrated in horizontally staggered relationship to each other and to blocks of different heights 122 and widths 123. Special blocks (not shown) may be used to support and/or connect the floors and the walls, or other building components.

In the perspective view of FIG. 10 illustrating a prototypical structural assembly, wall 130 is assembled by stacking together a plurality of corner blocks 131, typical building blocks 132, filler blocks 133, reduced height blocks 134, jamb blocks 136, eave blocks 137, sill blocks 138, and lintel blocks 139. Wall 140 is similarly assembled from a plurality of the foregoing building components, wherein alternative vertical wall courses 141 and 142, started with different size blocks, can be viewed as terminating at the roof structure 160. At the top of the vertical courses, it will be seen that courses commencing with reduced size typical blocks such as 134 may terminate with blocks of reduced size such as 143; whereas vertical courses commencing with full size typical blocks such as 132 may terminate with full size blocks such as 144, or eave blocks 137. Staggered stacking interlocking relationships between building blocks and courses in the foregoing drawing can be readily seen. It will be appreciated that walls assembled from the pressure molded masonry building blocks disclosed herein may be load-bearing walls, which is a further advantage of the present building system.

Floor structure 152 may be similar to that shown at 110 and/or 120 in FIG. 9. Roof structure 160 is shown at an inclined angle and is assembled in a manner similar to the blocks in the wall assemblage illustrated in FIG. 8, as well as the floor assemblage as indicated at 120 in FIG. 9. Typical blocks 161 are illustrated in staggered relationship to each other and to blocks of different "heights" 162 and "widths" 163.

It will be noted that by utilizing spaced jamb blocks spanned by lintel block 139, a self-framed interlocking masonry door opening may be obtained as in 170. Similarly, self-framed window or other openings may be obtained by utilizing spaced jamb blocks 136, a sill block 138, and a lintel block 139 as shown at 171. It will be appreciated that reduced height jamb blocks 151 may start and/or terminate the jamb courses at the door, window, or other self-framed openings in the continuous interwoven structural membrane.

Figure 11:
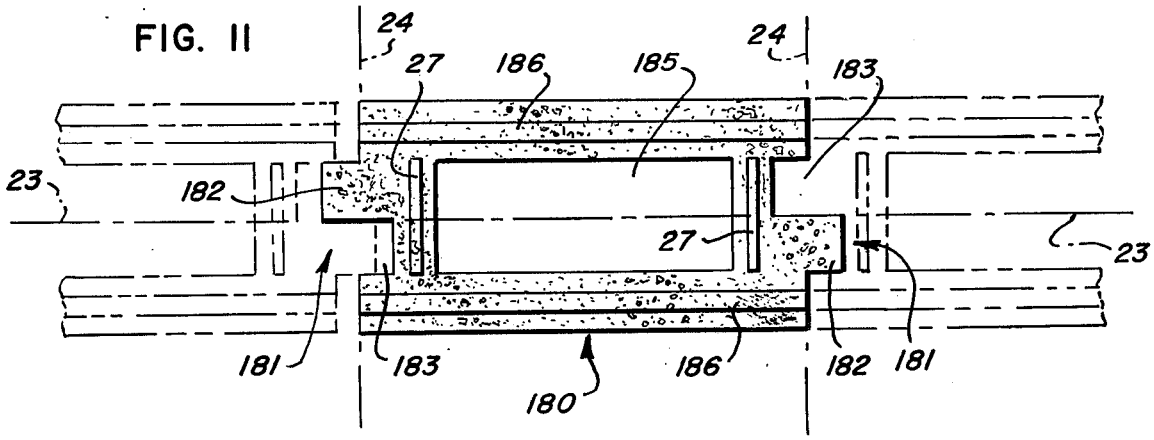
FIG. 11 is a top plan view of a building block similar to that in FIG. 1 except with alternative interlocking element configurations.

FIG. 11 illustrates a plan view of a pressure molded interlocking masonry building block 180 showing an alternative configuration of the yin yang locking elements 181 at each end of the typical block indicating a simplified configuration of the yin yang locking element 16 shown in FIG. 1. Alternative yin yang locking element 181 is shown without double-back-upon-itself feature. Nevertheless, this alternative yin yang interlocking relationship and configuration still retains the bisexual concept wherein each individual integral yin yang locking element 181 contains simultaneously both male and female complementary members 182 and 183, each being inboard of the sides.

The yin and yang members of one locking element 181 interlock with complementary yin and yang members of similar locking elements on adjacent blocks shown in phantom, in FIG. 11, to provide both interlocking and continuous integral weatherstopping relationships. There are thus two male members and two female members interlocking at each connection. This remains so in the simplified alternative yin yang configuration, as shown at 181 in FIG. 11, and it is this "sheared" bilateral symmetry along longitudinal axis 23 which enables horizontal reversibility of the two-faced interlocking building block 180, without disrupting the continuous integral interlocks and weatherstops 186 between the horizontal surfaces. Core 185 is also shown in the typical block.

It can thus be appreciated that all the combinations and permutations resulting because of the yin yang configurations as shown at 16 on typical block 11 in FIG. 1 can be similarly and advantageously provided in a building system using pressure molded masonry building blocks with alternative yin yang locking element configurations as shown at 181 in FIG. 11.

The embodiment of the yin yang locking element 181 allows blocks to be provided where such a yin yang element may be selectively provided on sides parallel to one axis, or sides parallel to a second axis normal to the first. The set of parallel sides not selected for the yin yang element is provided with the weatherstop interlock, as will be later shown.

Figure 12:
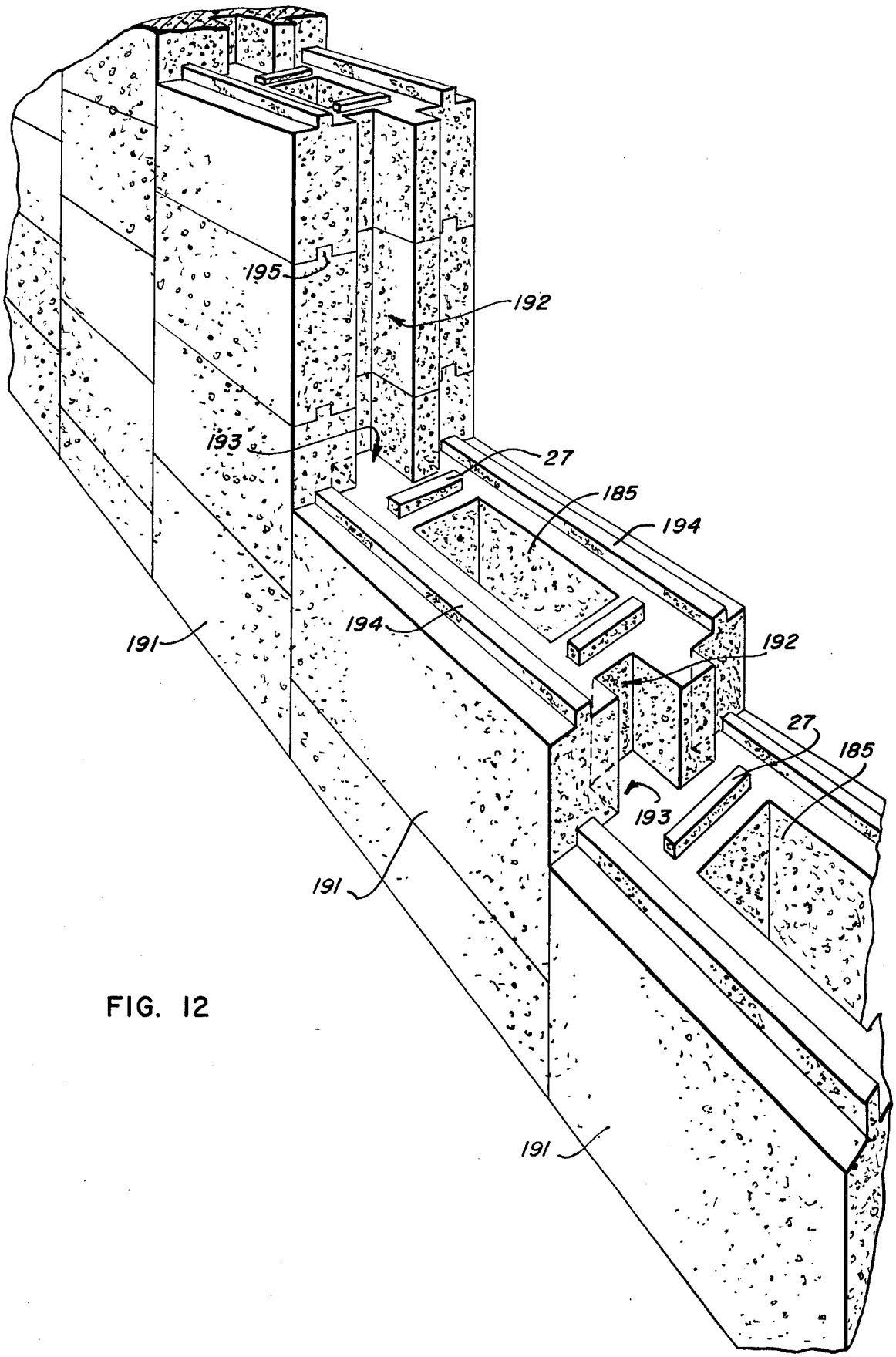
FIG. 12 is a cutaway perspective showing building blocks similar to that shown in FIG. 11, such building blocks being of varying heights to attain a vertically staggered stack bond interlocking relationship in a structure assembly.

FIG. 12 illustrates how typical blocks 191 with alternative yin yang configurations 192, 193, which are similar to those shown in block 180 in FIG. 11, can be assembled in vertically staggered stacked bond interlocking relationship similar to the system of assembly as described and shown in the view of FIG. 8. All of the features, as well as others, of the building blocks and building system described above are applicable to blocks formed with alternative integral yin yang elements 192 and 193, including continuous weatherstops 194 and 195.

Figure 13:
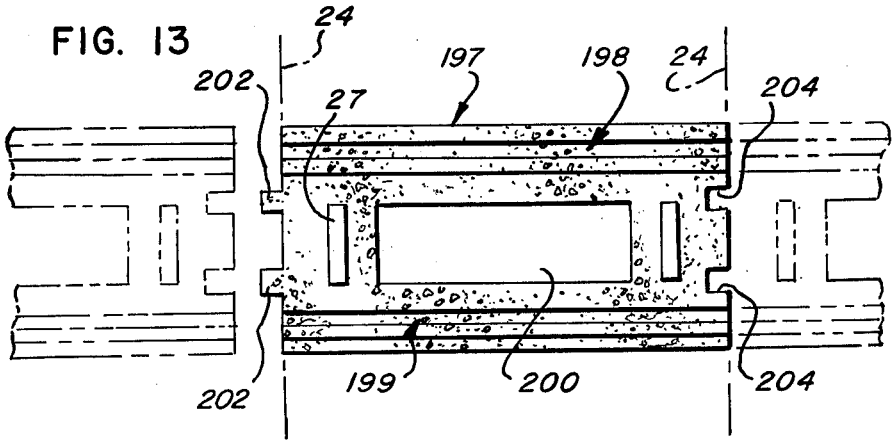
FIG. 13 is a top plan view of an alternative embodiment showing the yin yang elements on the top and bottom; and continuous interlocking and weatherstopping elements on the ends.

FIG. 13 shows a block 197 with yin yang elements 198, 199, located on top of the block on each side of core 200. The yin yang elements extend to opposite ends of the block 197 where elongated ribs or projections 202 and complementary elongated grooves or recesses 204 are located. Although not shown, the bottom of the block 197 will also have complementary yin yang elements such as 198, 199. Thus yin yang elements such as 198 and 199 may be selectively placed either on the ends, the sides, or the top and bottom of typical blocks. The block will have both the yin yang and weatherstop elements in the prefered form, but they can be placed on sides parallel to one axis, or on sides parallel to a second axis, which is normal to the first. This allows vertical reversibility and flexibility in use and design, especially since such yin yang elements may be further provided on the various types of blocks previously shown. If desired, the yin yang element may be on only one side so that the opposite side may be used for flush mating.

Figure 14:
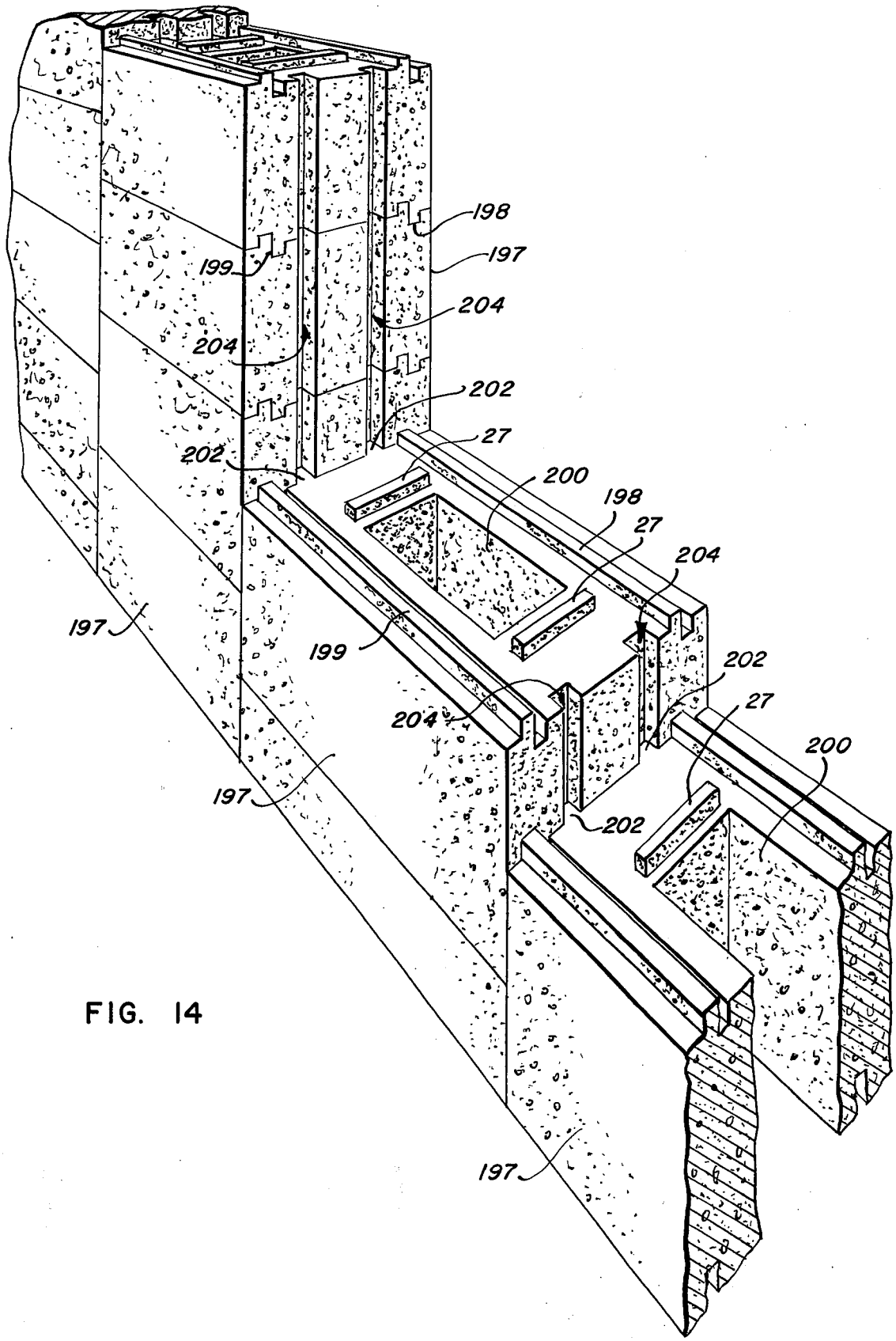
FIG. 14 is a cutaway perspective showing building blocks similar to those shown in FIG. 13, such building blocks being of varying heights to attain a vertically staggered stack bond interlocking relationship in a structure assembly.

FIG. 14 shows how blocks such as 197 can be assembled in vertically staggered stacked bond interlocking relationship similar to the system of assembly as shown in the views of FIGS. 8 and 12. All of the features, as well as others, of the building blocks and building system described above are applicable to blocks formed with integral yin yang elements such as 198, 199.

The preferred embodiment also includes transverse ribs or projections 27, it being understood that complementary transverse grooves or recesses are provided on the bottom, not shown. Such transverse locking elements particularly enhance the interlock of blocks provided with yin yang elements such as 198, 199. It is seen that blocks with branched or around-and-in yin yang elements require movement along a path which is parallel or coplanar with the ends having such elements to effect the yin yang joint. The straight sided or unbranched yin yang element, such as 181, 198, 199, can form a yin yang joint by moving blocks along a path normal to the sides or ends on which such yin yang elements are integrally formed.

The foregoing drawings are intended only to illustrate preferred, improved interlocking masonry building blocks and preferred assemblage of a plurality of said preferred building blocks, and are not intended to limit the possible variations and combinations of either the design and geometry of the individual pressure molded masonry building blocks, the configurations of the yin yang and other locking elements, or of the myriad ways in which such pressure molded masonry building blocks can be woven together in continuous interlocking masonry membranes to form a virtually unlimited variety of structures. Ribs and grooves, for example, may be rounded in the preferred form for greater ease in molding.

It is basic to the improved building system of the present invention only that a plurality of pressure molded masonry building blocks whose dimensions and physical characteristics are precisely and accurately predetermined and formed, are "woven" together in staggered stack bond interlocking relationship. This can be done in either the vertical, horizontal, curved, or inclined planes, so that a three-dimensional continuous weathertight masonry membrane structure is attained whose elements are integral, indivisible parts of the whole. Each block is formed with integral two-way continuous interlocking and weatherstopping elements, including a yin yang element to interlock and form a weatherstop along one axis, and complementary continuous elongated projections and recesses to interlock and form a weatherstop along another axis. Practitioners will appreciate that employment of the present building system can provide such structural assemblies as interlocking paving blocks and tiles for floors, roads, and the like; bulkheads and retaining walls; flood and erosion control assemblies; silos; stacks; cooling towers; tunnels; dams; bridges; arches; vaults; domes, and still others.

The terms universal referring to the yin yang interlocking concept is understood to mean that the above described system of building may be viewed as consisting of a network of complementary and reversible integral self-jointing locking elements which are connected together by pressure molded masonry building blocks. It is only important that each above-described locking element be substantially similar to each other like locking element within a given system, and it can thus be appreciated by practitioners that the shape and dimension of the individual construction components or modules may be varied in virtually unlimited ways to make them suitable for the work at hand. Such different construction components as sills, lintels, foctings, columns, capitals, beams, girders, arches, curbing, copings, tiles, paving blocks, and still others may be provided with integrally formed locking and weatherstopping elements, as described above, to permit complementary and universal interlocking in a structural assembly.

It should be understood, however, that thin bed or film adhesives may be provided between such surfaces and interfaces without frustrating the predeterminable and rationally analyzable structural behavior characteristics of the building system. Such a thin bed adhesive may be applied as a bead by a caulking gun or the like, and thereafter spread thinly between the mating surfaces by the weight or applied pressure of the improved masonry building blocks. An adhesive film may be applied, such as an epoxy, urethane or other resin or resin-based adhesive, by spraying, rolling, brushing or the like. Neither the thin film nor thin bed adhesives necessarily result in the reduced strength or distortion characteristics of a thick mortar joint, since no distinct body of such an adhesive is built up between adjoining pressure molded building blocks.

It will be understood that the individual standardized uniform pressure molded interlocking masonry building blocks can be viewed as being modularly dimensioned to provide modular coordination in the resulting assemblage of such building blocks. Each improved pressure molded masonry building block or module will conform to predetermined and accurate dimensions and physical characteristics which enables the practitioner to appreciate the further advantage of being able to reliably design and assemble a structure in accordance with a pre-selected modular construction pattern.

Still other advantages of the building system will become apparent to practitioners such as:

1. The reversibility inherent in the balanced-design two-way symmetry of the yin yang locking element, which enables universal connection between building blocks of different shapes;

2. The precision and accuracy of forming the dimensions and physical characteristics of the pressure molded masonry building blocks, which enables them to be assembled with or without mortar in staggered stack bond interlocking relationship such that the resulting assembled structure is simultaneously interlocked and weathertight between all mating surfaces, and such that rectilinearity, plumbness and self-reinforcement, etc., are assured because of the smooth and parallel surfaces as well as the vertical and horizontal interlocking features of the blocks; in addition, the practicality of continuous and clean cores or passageways inherent throughout the system will be evident.

3. The fact that no mortar is necessary in the assembly process enables single-phase structures to be assembled or disassembled quickly and simply under all weather conditions without the disadvantages normally associated with the conventional use of mortar, such as: additional cost; additional labor and still required for mixing, transporting, applying, cleaning and maintaining of mortared joints; shrinkage, cracking, leakage and strength deformation factors, etc., which may result from unfavorable ambient conditions, or otherwise.

4. The simplicity and economy of the pressure molded, chemically bonded manufacturing processes, which enables reduced investment in capital expenditures for production facilities and reduced production operating expenses.

5. The ability to utilize virtually any inorganic solid material as a basic aggregate in the manufacture of the improved pressure molded interlocking masonry building blocks which enables a variety of industrial, commercial, municipal and other waste by-products and hitherto unrecovered resources to be recycled for the purpose of obtaining various types of aggregate for the improved building blocks, as well as the use of sand or other natural mineral matter. Besides the use of fly ash, furnace slag, sewage sludge, incinerated garbage residue, waste glass, etc., it will be evident that still other waste products can be considered by the practitioner as a source of aggregate in making the accurately dimensioned pressure molded interlocking masonry building blocks used in the building system of the present invention.

6. The fact that the system of building described above may also utilize building blocks made from both pressure molded or extruded fired clay or shale materials and conventional concrete masonry materials and processes, which enables brick and block to be made and assembled in the manner indicated above, i.e., with integral two-way simultaneously interlocking elements, which may be woven together into continuous three-dimensional structural membranes.

7. The usability of the above type of interlocking building blocks in the manufacture of refractories and other non-metallic materials suitable for the construction or lining of furnaces operated at high temperatures (or in high radiation uses such as for atomic reactors), which enable practitioners to build said structures without the use of mortar and its concomitant disadvantages, many of which are the same disadvantages as those associated with masonry construction; reduction in strength and other physical characteristics, and the need for skilled and quality workmanship necessary to apply the mortar; plus additional disadvantageous aspects of mortar used with refractories: his need to be resistant to high temperatures, resistance to chemical attack, abrasion, impact, spalling, resistance to slag attack, and still others.

Practitioners will also realize that the advantages of the improved integrally formed interlocking building block and improved method of assemblage can be enjoyed in fields of use other than the construction industry. It will be appreciated that toy, educational, anti-radiation, refractory, or other types of interlocking building blocks can be made with yin yang locking elements, and that such building blocks can be molded from economical plastics or other materials.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be secured by Letters Patent is:

1. A building block, including i. a unit having a plurality of sides including a top, a bottom and an opposite pair of sides, and ii. at least one integral complementary element symmetrically located with respect to a bilateral plane and adapted for effecting continuous weatherstops along said top and bottom sides when assembled with similar blocks, and iii. an integrally formed unitary continuous self-jointing element on at least one side of the unit, said self-jointing element being complementary with similar elements on other blocks, comprising a. an element inboard from a side wall, extending beyond said block and forming a doubled back male locking projection, which thus creates therewith, b. a contiguous element inboard from the opposite side wall, recessed into said block, complementary with said element (a) and forming a doubled back female locking recess complementary with said formed male locking projection, the shape, area and volume of said formed male locking projection and said formed female locking recess being substantially equal, said continuous self-jointing element being capable of joining with a complementary substantially similar self-jointing element on a side of another building block, the formed male locking projection of each building block being capable of snug universal positive two-way interlocking relationship with the complementary formed female locking recess of each adjacent similar block, thus enabling said block to be selectively reversible around a vertical axis, and thus enabling each continuous self-jointing element to universally join with a complementary self-jointing element on another block in a positive two-way interlocking relationship without disturbing the continuity of weatherstops along said top and bottom sides when assembled with other similar blocks.

2. A building block, including i. a unit having a plurality of sides including a top, a bottom and an opposite pair of sides, and ii. at least one integral complementary element symmetrically located with respect to a bilateral plane and adapted for effecting continuous weatherstops along said top and bottom sides when assembled with similar blocks, and iii. an integrally formed unitary continuous self-jointing element on at least one side of the unit, said self-jointing element being complementary with similar elements on other blocks, comprising a. an element inboard from a side wall, extending beyond said block and forming a male locking projection, which thus creates therewith, b. a contiguous element inboard from the opposite side wall, recessed into said block, complementary with said element (a) and forming a female locking recess complementary with said formed male locking projection, the shape, area and volume of said formed male locking projection and said formed female locking recess being substantially equal, said continuous self-jointing element being capable of joining with a complementary substantially similar self-jointing element on a side of another building block, the formed male locking projection of each building block being capable of snug universal interfitted relationship with the complementary formed female locking recess of each adjacent similar block, thus enabling said block to be selectively reversible around a vertical axis, and thus enabling each continuous self-jointing element to universally join with a complementary self-jointing element on another block without disturbing the continuity of the weatherstops along said top and bottom sides when assembled with other similar blocks.

3. A building block as defined in claim 2 wherein:

a top side includes at least one continuous raised strip;

a bottom side includes at least one continuous recessed slot, said bottom side being capable of interfitting with a corresponding top side of another such block; and at least one self-jointing element comprises a projected strip and a recessed slot, said self-jointing elenent being continuous between the top side and the bottom side of said block.

4. A building block as defined in claim 3 wherein, in each self-jointing element, each projected strip and each recessed slot is substantially rectangular in cross-section.

5. A building block as defined in claim 3 wherein, in each self-jointing element, each projected strip is laterally offset with respect to each recessed slot so that each said self-jointing element comprises an interfitting L-shaped hook and an L-shaped catch.

6. A building block which includes the features of claim 5 above, wherein the unit is a stretcher block having self-jointing elements on two opposite sides.

7. A buildng block as defined in claim 3 wherein:

a top side includes at least one continuous raised strip;

a bottom side includes at least one continuous recessed slot, said bottom side being capable of interfitting with a corresponding top side of another such block and thus effecting a continuous weatherstop therewith; and at least one self-jointing element being like all other self-jointing elements on said block or other such blocks, and wherein said self-jointing element comprises a projected strip and a recessed slot, said self-jointing element being continuous between the top side and the bottom side of said block, each projected strip having substantially the same shape, area and volume as each said recessed slot, enabling snug interfitting therewith; each projected strip and each recessed slot of each said self-jointing element being substantially rectangular in cross section and each projected strip of each said self-jointing element being laterally offset with respect to each recessed slot so that each self-jointing element comprises a complementary L-shaped hook and an L-shaped catch.

8. A building block which includes the features of claim 7 above, wherein a third self-jointing element is normal to the two opposite sides containing self-jointing elements.

9. A building block which includes the features of claim 7 above, wherein the unit is a corner block having self-jointing elements on two adjoining sides.

10. A building block which includes the features of claim 7 above, wherein the unit is a jamb or end block having a self-jointing element on one side.

11. A building block which includes the features of claim 7 above, wherein the unit is a center block having self-jointing elements or four adjoining sides.

12. A building block which includes the features of claim 7 above, wherein the top side includes spaced continuous raised strips and spaced transverse raised strips, and the bottom side includes complementary, continuous recessed slots and spaced transverse recessed slots.

* * * * *

UNITED STATES PATENT AND TRADEMARK OFFICE

CERTIFICATE OF CORRECTION

PATENT NO. : 4,041,670

DATED : August 16, 1977

INVENTOR(S) : Richard D. Kaplan

It is certified that error appears in the above-identified patent and that said Letters Patent are hereby corrected as shown below:

In Col. 1, line 10, delete "pressure"; on line 16, delete "pressure"; and on line 59, change "motar" to read --mortar--.

In Col. 2, line 4, change "motar" to read --mortar-- and delete the semicolon (;); on line 6, change "motar" to read --mortar--; on line 20, change "motar" to read --mortar--; on line 34, change "motar" to read --mortar--; on line 54, delete "pressure", and on line 66, delete "pressure".

In Col. 3, line 6, delete "pressure"; on line 35, delete "pressure"; on line 44, delete "pressure"; and on line 58, delete "pressure".

In Col. 4, line 53, delete "pressure"; and on line 67, delete "pressure".

In Col. 5, line 2, delete "pressure"; on line 6, delete "pressure"; on line 9, delete "pressure"; on line 16, delete "pressure"; on line 33, delete "pressure"; on line 42, delete "pressure"; on line 46, delete "pressure"; on line 54, delete "pressure"; and on lines 57-58, delete "pressure".

In Col. 6, line 6, delete "pressure"; on line 14, delete "pressure"; on line 47, delete "pressure"; on line 51, delete "pressure" and on line 56, delete "pressure".

In Col. 7, lines 4-5, delete "pressure".

In Col. 8, line 8, delete "pressure".

In Col. 9, line 20, delete "pressure".

In Col. 11, line 42, delete "pressure".

UNITED STATES PATENT AND TRADEMARK OFFICE

CERTIFICATE OF CORRECTION

PATENT NO. : 4,041,670

DATED : August 16, 1977

INVENTOR(S) : Richard D. Kaplan

It is certified that error appears in the above-identified patent and that said Letters Patent are hereby corrected as shown below:

In Col. 12, line 5, delete "pressure".

In Col. 13, line 50, delete "pressure".

In Col. 15, line 2, delete "pressure"; on line 23, delete "pressure"; and on line 55, delete "pressure".

In Col. 16, line 54, delete "pressure"; on line 57, delete "pressure"; and on line 64, delete "pressure".

In Col. 17, line 22, delete "pressure"; on lines 50-51, delete "pressure"; on line 53, delete "pressure"; and on line 56, delete "pressure".

In Col. 18, line 2, delete "pressure"; on line 24, delete "pressure"; on line 32, delete "pressure"; on line 43, delete "pressure"; and on line 48, delete "pressure".

In Col. 20, line 40, "elenent" should read --element--.

In Col. 22, line 9, "or" should read --on--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*